US006213093B1

(12) United States Patent
Yudanov et al.

(10) Patent No.: US 6,213,093 B1
(45) Date of Patent: Apr. 10, 2001

(54) HYDRAULICALLY ACTUATED ELECTRONIC FUEL INJECTION SYSTEM

(76) Inventors: Sergi Yudanov, Bernhards Grand 7, LGH 80, Gothenburg 41842 (SE); William Richard Mitchell, 10 Macintyre Crescent, Sylvania Waters, New South Wales 2224 (AU)

( * ) Notice: Subject to any disclaimer, the term of this patent is extended or adjusted under 35 U.S.C. 154(b) by 0 days.

(21) Appl. No.: 09/445,623

(22) PCT Filed: Feb. 10, 1998

(86) PCT No.: PCT/AU98/00073

§ 371 Date: Jan. 14, 2000

§ 102(e) Date: Jan. 14, 2000

(87) PCT Pub. No.: WO98/35158

PCT Pub. Date: Aug. 13, 1998

(30) Foreign Application Priority Data

Feb. 10, 1997 (SE) ..... PO 5018

(51) Int. Cl.[7] ..... F02M 37/04
(52) U.S. Cl. ..... 123/446; 123/506
(58) Field of Search ..... 123/446, 447, 123/467, 506, 300

(56) References Cited

U.S. PATENT DOCUMENTS 5,492,098 2/1996 Hafner et al. ..... 123/446
5,655,501 8/1997 Hafner ..... 123/496
5,662,087 * 9/1997 McCandless ..... 123/446
5,722,373 * 3/1998 Paul et al. ..... 123/446
5,785,021 * 7/1998 Yudanov et al. ..... 123/446
5,996,558 * 12/1999 Ouellette et al. ..... 123/446

FOREIGN PATENT DOCUMENTS

WO 95/21999 8/1995 (WO) .

OTHER PUBLICATIONS

Derwent Abstract Accession No. 92–347048/42, Class Q53, SU 1671938 A (MOSC Auto Road Constr Inst) Aug. 23, 1991.

* cited by examiner

*Primary Examiner*—Thomas N. Moulis
(74) *Attorney, Agent, or Firm*—Gifford, Krass, Groh, Sprinkle, Anderson & Citkowski, P.C.

(57) ABSTRACT

A hydraulically actuated electronically controlled fuel injection system comprises a pressure intensifier (6, 7) associated with a hydraulically controlled differential valve (4) having a poppet valve (27) opening into a working chamber (10) of the pressure intensifier (6, 7). An external groove (8) is provided on the plunger (7) of the intensifier (6, 7) for connection of the plunger's compression chamber (12) with a nozzle's locking chamber (17) during an injection cut-off period.

16 Claims, 8 Drawing Sheets

HYDRAULICALLY ACTUATED ELECTRONIC FUEL INJECTION SYSTEM

TECHNICAL FIELD

The present invention relates to a system and means for injecting fuel into internal combustion engines.

BACKGROUND ART

Some fuel injection systems have been designed as unit injectors which incorporate an hydraulically driven pressure intensifier with a stepped plunger for injecting fuel into an engine's cylinder where the fuel delivery and timing are controlled by an electronically controlled valve. The spray pattern of each injector is controlled by means of modulating the base oil pressure supplied to each unit injector.

It is known that in many diesel engines the optimum injection curve shapes vary depending on the engine's operating conditions. A pilot injection of a small amount of fuel separate from a main injection may be required at some operating conditions and a boot-shaped injection at other conditions, or a sharp leading front of an injection curve may be the best for another engine speed and load. The correlations between engine operating conditions and the optimum shapes of the injection curves are often complex. Therefore it is desirable for a diesel injection system to have the shape of an injection curve electronically controlled, so that an engine management system can set the optimum injection characteristics for a wider range of engine operating conditions.

Known unit injection system do not enable control of an injection curve shape independently from the actuating pressure due to the lack of a control channel which can be connected to a nozzle's locking chamber during certain stages of a plunger's metering and injection strokes.

The present invention concerns hydraulically actuated electronically controlled unit injection (HEUI) systems which are well known. The closest art known to the present invention is that of PCT/AU98/0073, the contents of which are incorporated herein by reference.

The difference between the injector and injection system of a first aspect of the present invention and that disclosed in PCT/AU98/0073 resides in the provision of an external groove on the plunger for connection of a plunger's compression chamber with a nozzle's locking chamber during an injection cut-off period.

A second aspect of the present invention resides in the inclusion of a control channel for stabilization and control of the pressure in the locking chamber during parts of the metering and injection strokes of a pressure intensifier, wherein this control channel and the locking chamber can be disconnected from each other by the plunger during an injection cut-off. The pressure in the control channel is typically controlled by an engine management system. When the control channel pressure is increased, the pressure in the compression chamber required to open the nozzle and begin the injection also increases, therefore the leading edge of the injection curve steepens. By means of varying the pressure in the control channel the shape of the leading edge of an injection curve can be controlled.

It is preferable to join the control channels of a set of unit injectors of an engine into a common control chamber with pressure in this chamber controlled by an engine management system. This ensures uniform injection timingmmon control chamber with pressure in this chamber controlled by an engine management system. This ensures uniform injection timing and shape of injection curves in the engine cylinders, simplifies the injection system design and helps keep the cost down as in this case only one pressure regulator is required and it can be mounted anywhere on an engine.

Throughout this specification, unless the context requires otherwise, the word "comprise", or variations such as "comprises" or "comprising", will be understood to imply the inclusion of a stated element or integer or group of elements or integers but not the exclusion of any other element or integer or group of elements or integers.

DISCLOSURE OF INVENTION

In accordance with a first aspect of the present invention there is provided a fuel injector of an injection system for an internal combustion engine, said injector comprising an inlet port; a spill port; a pressure intensifier comprised of a piston forming a working chamber and a spill chamber and a plunger forming a compression chamber, said spill chamber being connected to the spill port via a spill channel, said plunger having a control edge adapted to vary the flow area of said spill channel and close it off in dependence upon the plunger position; a nozzle with a needle, a locking chamber, means biasing the needle to close the nozzle and an outlet chamber connected to the compression chamber; a non-return valve, the inlet of the non-return valve being connected to the inlet port and the outlet of the non-return valve being connected to the compression chamber; an hydraulically controlled differential valve (HDV) comprising an HDV control chamber and having a valve located between the inlet port and the working chamber and opening into the working chamber upon opening, wherein said valve provides a throttling slot and a chamber connected to the HDV control chamber; resilient means biasing the HDV towards its closed position; a control valve installed between the HDV control chamber and the spill port; a cut-off channel connected to the locking chamber; a control channel connected to the spill port; said plunger having an external groove positioned so as to connect the cut-off channel to the compression chamber at an injection cut-off position of the plunger and adapted to connect the cut-off channel to the control channel at other positions.

In a preferred form of the first aspect, the valve located between the inlet port and the working chamber is a poppet with a seating face.

A fuel injection system for controlling an injector of the present invention comprises means for controlling the pressure in the control channel and means for detecting the start of injection comprising a pressure sensor installed in the control channel and an electronic conditioning unit.

In a second aspect the present invention consists in a fuel injector of a fuel injection system for an internal combustion engine, said injector comprising an inlet port; a spill port; a pressure intensifier comprised of a piston forming a working chamber and a spill chamber and a plunger forming a compression chamber, said spill chamber being connected to the spill port via a spill channel; said plunger having a control edge adapted to vary the flow area of said spill channel and close it off in dependence upon the position of the plunger; a nozzle with a needle, means biasing the needle to close the nozzle, an outlet chamber connected to the compression chamber and a locking chamber; a non-return valve, the inlet of the non-return valve being connected to the inlet port and the outlet of the non-return valve being connected to the compression chamber; an hydraulically controlled differential valve (HDV) comprising an HDV control chamber and having a valve located between the inlet port and the working chamber and opening into the working chamber upon opening; resilient means biasing the HDV towards its closed position; a control valve installed between the HDV control chamber and the spill port and adapted to connect said HDV control chamber with the spill port upon command from an engine management system; a cut-off channel connected to the nozzle locking chamber; a control channel connected to the cut-off channel; an additional control valve installed between the control channel and the spill port; said plunger having an external groove positioned so as to connect the compression chamber to the cut-off channel during an injection cut-off position of the plunger.

In a preferred embodiment of the second aspect of the invention, the valve located between the inlet port and the working chamber is a poppet with a seating face.

The present invention is related to unit injectors but includes features which enable electronic control to be applied to the shape of the injection curve of a unit injector independently of the base fluid pressure. In another aspect of the present invention the stability of fuel delivery in consecutive cycles of injections and between the unit injectors of a multi-cylinder engine can be facilitated. Differing embodiments of this invention enable simplification of a unit injector's design, reduce it's dimensions and the noise of it's operation.

Fuel injection systems according to embodiments of the present invention can be designed to provide an ability to markedly vary the shape of an injection curve as well as a wide range of fuel injection pressures, high maximum injection pressure, sharp injection cut-off which is necessary at all engine operating conditions, improved fuel delivery control accuracy and reduced noise of fuel system operation.

BRIEF DESCRIPTION OF DRAWINGS

The present invention will now be described by way of example with reference to the accompanying drawings, in which.

BEST MODES

Figure 1:
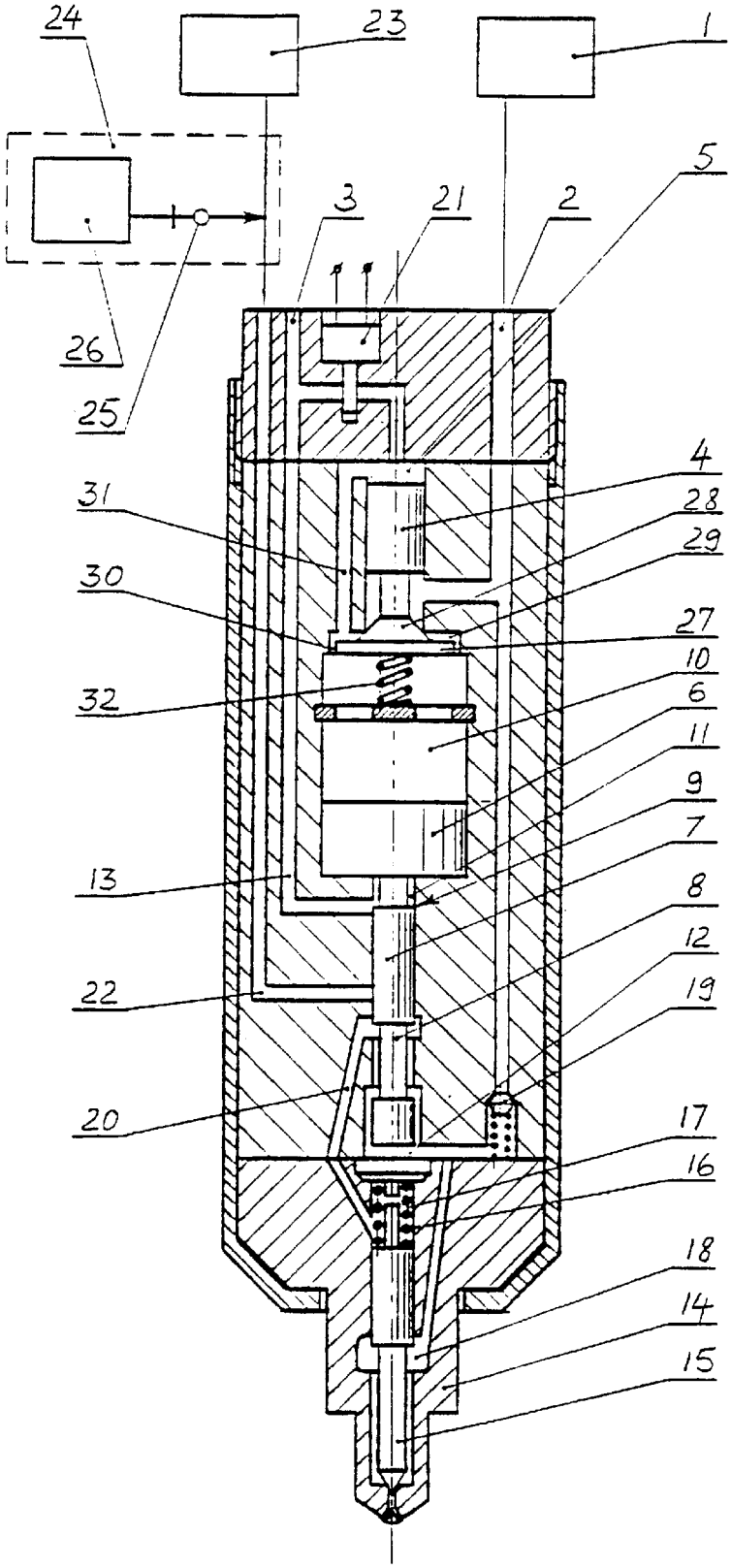
FIGS. 1 and 2 are longitudinal cross sectional views through an hydraulically actuated unit injector in accordance with a first embodiment of the present invention at different stages of operation.

The embodiment of FIG. 1 shows a source of fuel pressure 1, inlet port 2, spill port 3, hydraulically controlled differential valve (HDV) 4, HDV control chamber 5, a pressure intensifier which is comprised of piston 6 and plunger 7 with the external groove 8 and the edge 9, working chamber 10, spill chamber 11 and compression chamber 12, spill channel 13, nozzle 14, needle 15, spring 16, locking chamber 17 and outlet chamber 18, non-return valve 19 the inlet of which is connected to the inlet port 2 and the outlet of which is connected to the compression chamber 12, cut-off channel 20, solenoid valve 21 installed between the HDV control chamber 5 and the spill port 3, control channel 22, the system 23 for controlling the pressure in the control channel 22 and the system 24 for detecting the start of injection consisting of a pressure sensor 25 installed in the control channel 22 and an electronic conditioning unit 26. The HDV 4 controls the flow area from the inlet port 2 to the working chamber 10 and opens towards the working chamber. The HDV 4 has the poppet 27 with seating face 28 and forms poppet chamber 29 and throttling slot 30. The poppet chamber 29 is connected to the HDV control chamber 5 via bypass channel 31. The HDV 4 is biased towards its closed position by the spring 32. The compression chamber 12 is connected with the outlet chamber 18. The compression chamber 12 may also be connected with the cut-off channel 20 through the external groove 8 of the plunger 7 depending on the plunger's position. The cut-off channel 20 may be connected to the control channel 22 through groove 8 of the plunger 7 depending on the plunger's position. The spill channel 13 may be connected to spill chamber 11 depending on the plunger's position.

Figure 3:
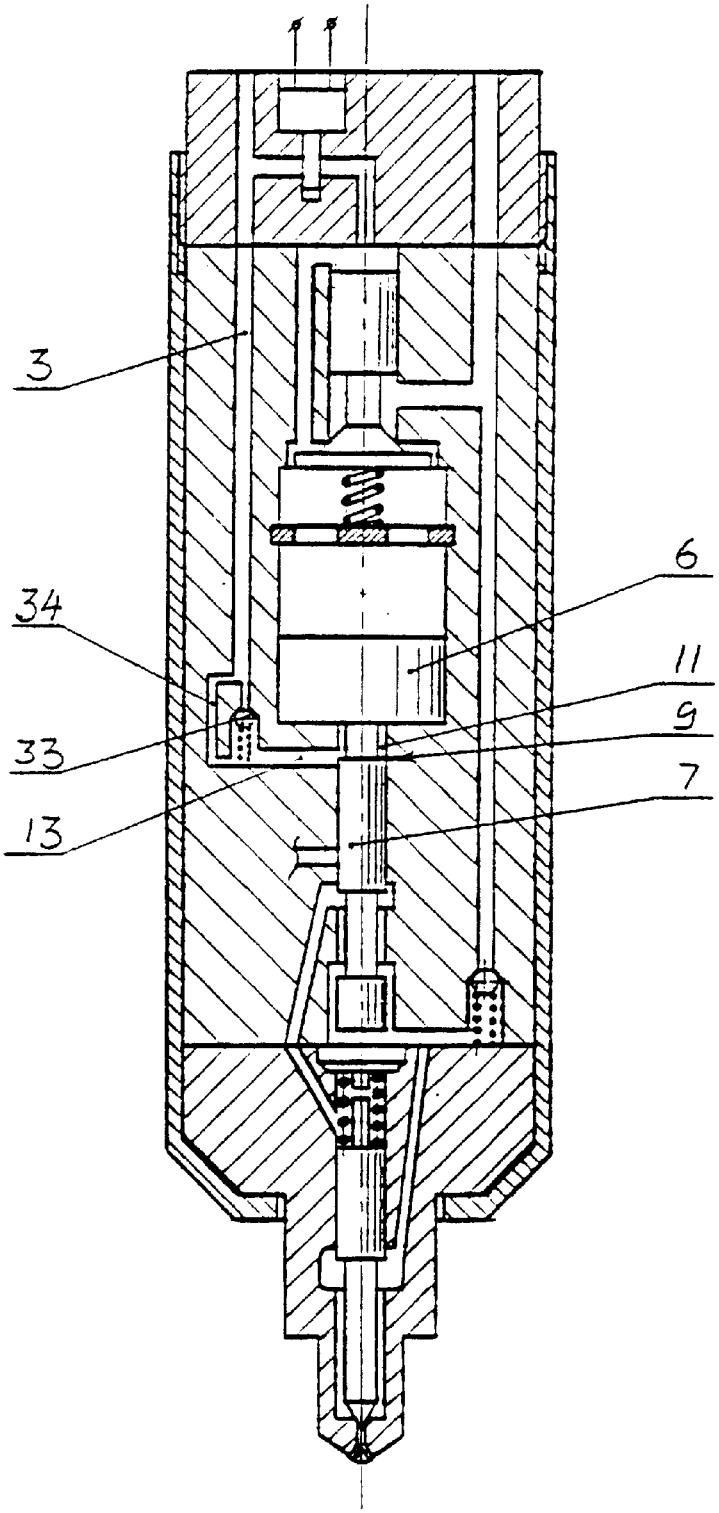
FIG. 3 is a longitudinal view of a second embodiment of the present invention.

A second embodiment of the invention is shown in FIG. 3 which is identical to that shown in FIG. 1 except that there is a non-return valve 33 installed in the spill channel 13, the inlet of the non-return valve is connected to the spill port 3 and the outlet of the non-return valve is connected to the spill chamber 11. There is also a bypass spill channel 34 connecting the inlet of the non-return valve 33 to it's outlet.

Figure 4:
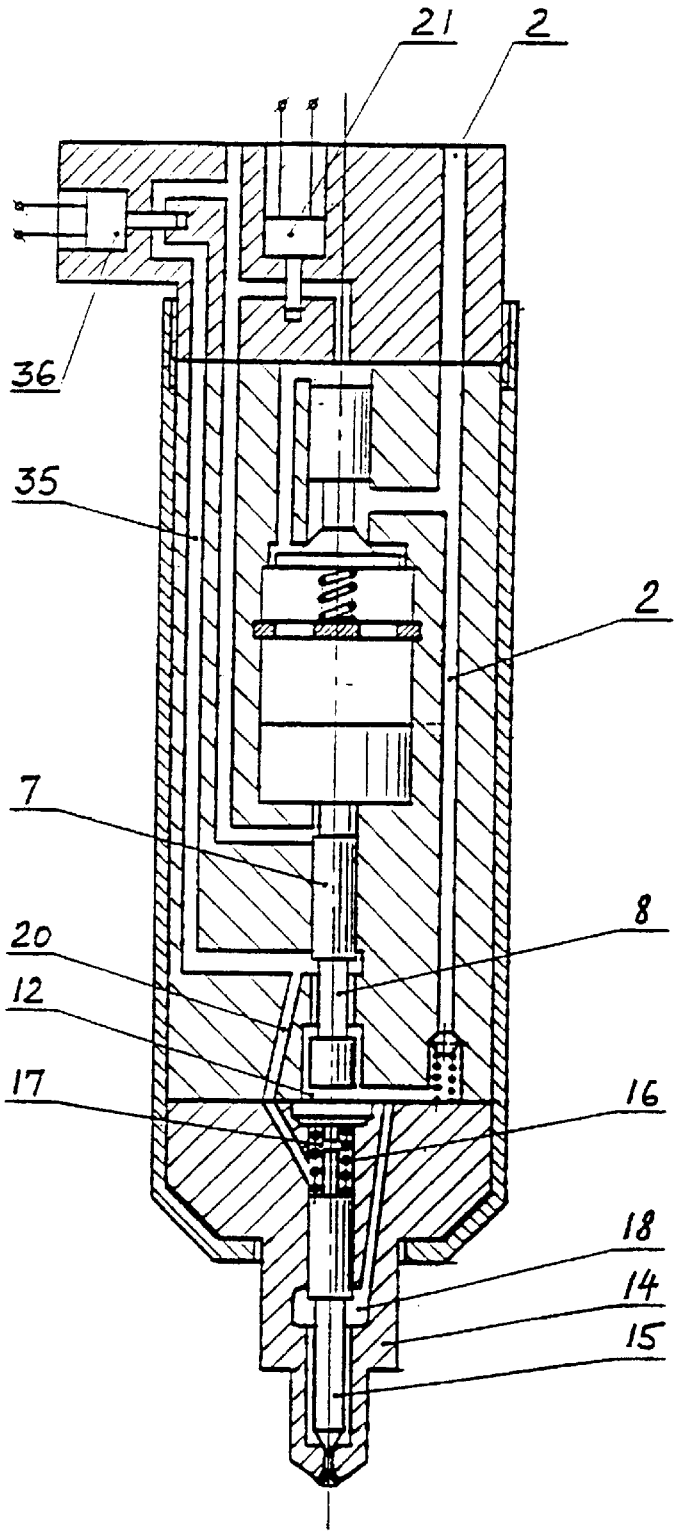
FIG. 4 is a cross sectional view of a third embodiment of the present invention.

A third embodiment of the invention is shown in FIG. 4 which is identical to that shown in FIG. 1 except that the control channel 35 is connected to the cut-off channel 20 and there is an additional solenoid valve 36 controlling the pressure in the control channel 35.

Figure 5:
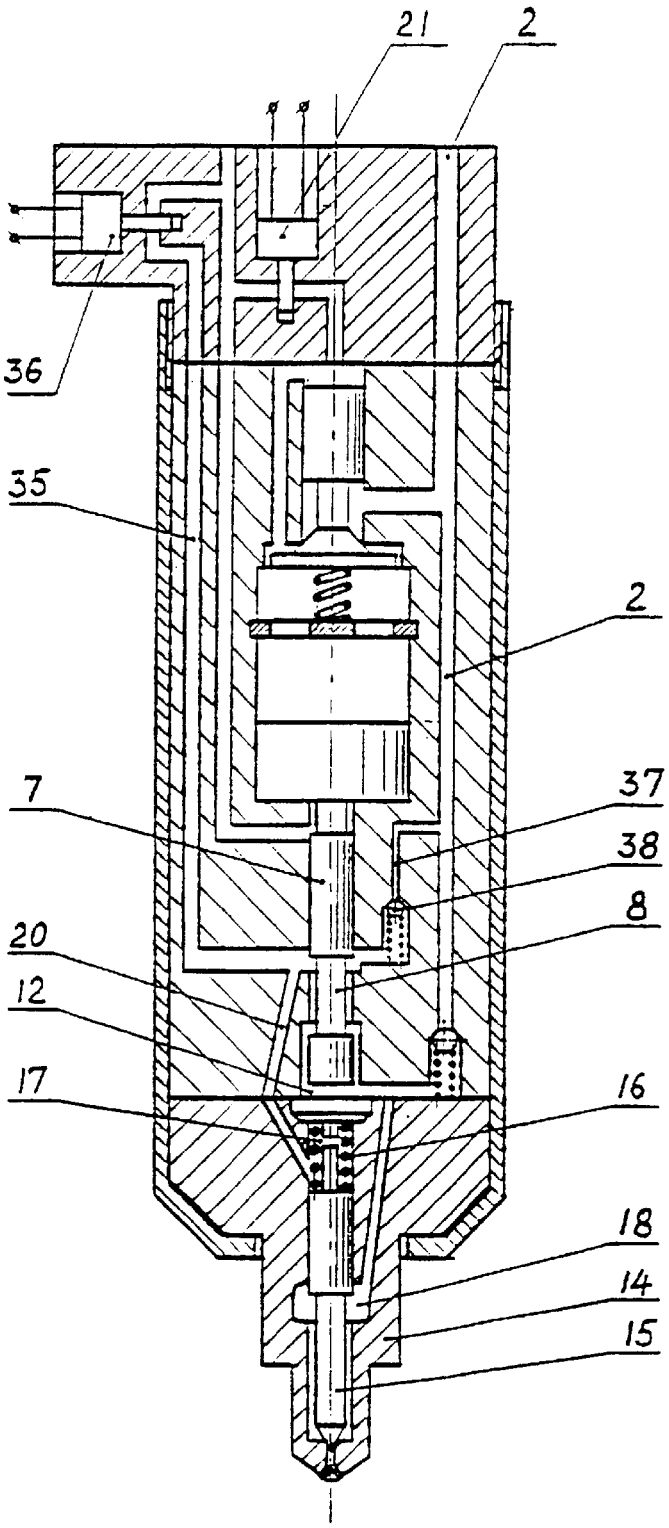
FIG. 5 is a cross sectional view of a fourth embodiment of the present invention.

A fourth embodiment of the invention is shown in FIG. 5, which is identical to that shown in FIG. 4 except that there is a link channel 37 connecting the inlet port 2 to the locking chamber 17 through a non-return valve 38 the inlet of which is connected to inlet port 2.

Figure 6:
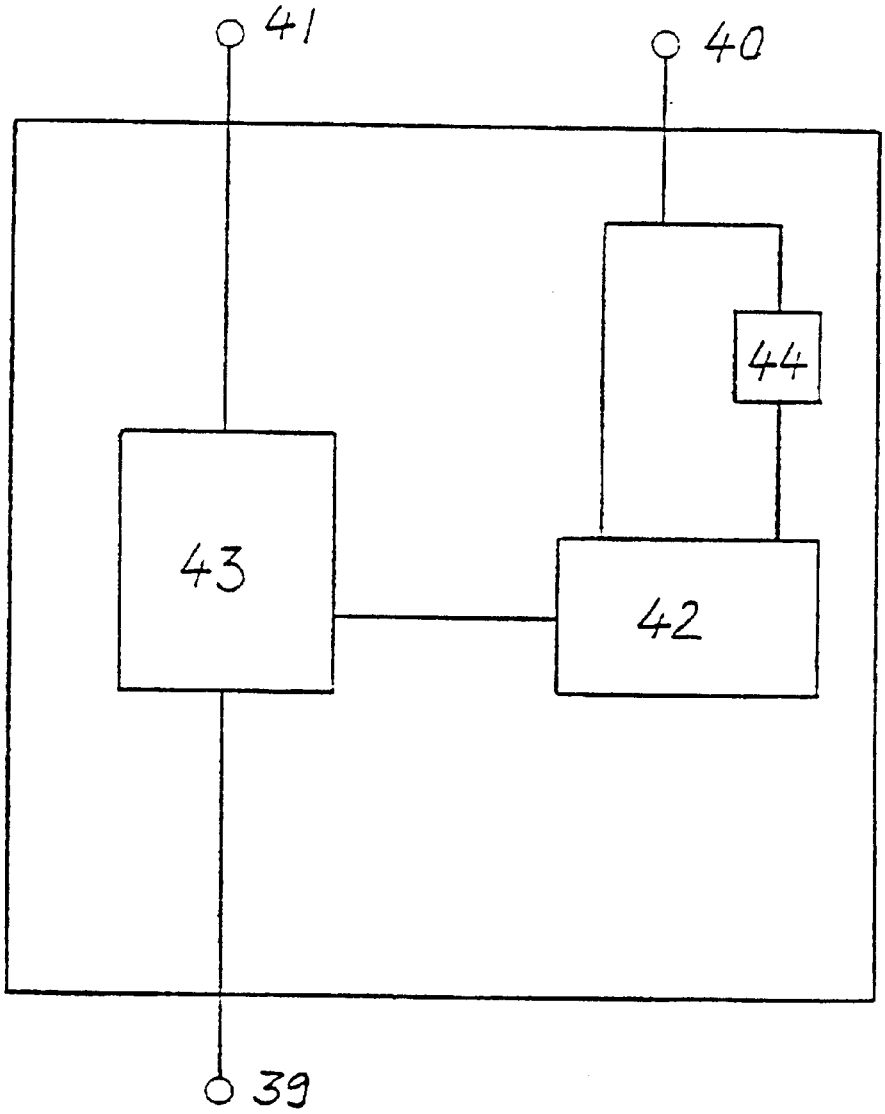
FIG. 6 is a schematic of an electronic conditioning unit in a system of detection of the start of an injection.

FIG. 6 is a schematic of an electronic conditioning unit which generates a trigger on its output 39 used by an engine management system (not shown) as a start of injection mark. It comprises an input 40 from the pressure sensor 25 (Ref. FIG. 1), an input 41 (Ref. FIG. 6) from the engine management system, a comparator 42, a counter 43 and a filter 44.

A fuel injection system of the depicted embodiments works as follows:

Referring to FIG. 1, in the initial position the solenoid valve 21 is inert and closes off the connection between HDV control chamber 5 and spill port 3. The HDV 4 is closed, the piston 6 and plunger 7 are kept in the bottom position by the fuel pressure in the working chamber 10, the locking chamber 17 is connected via the cut-off channel 20 and the plunger's external groove 8 with compression chamber 12, the nozzle 14 is closed by the needle 15. The spill chamber 11 is connected to the spill port 3 via spill channel 13.

Figure 2:
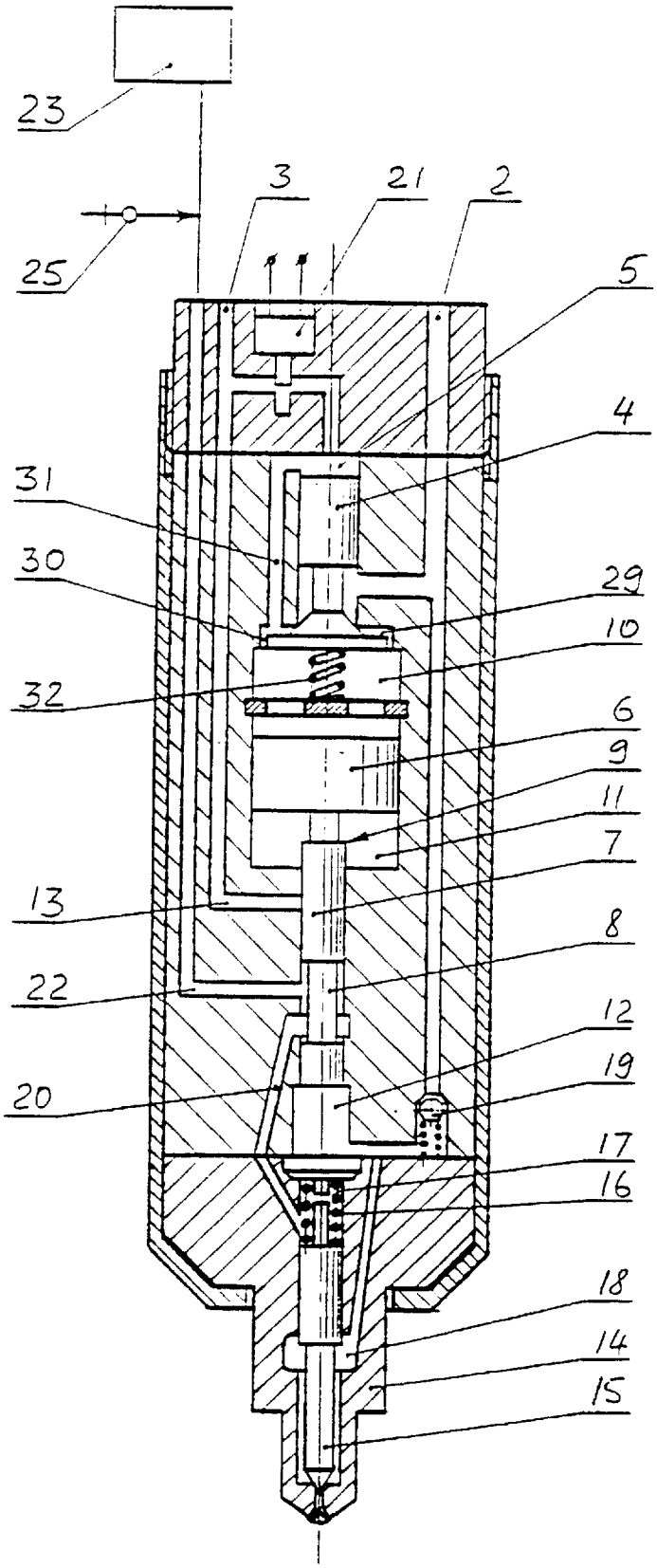

Referring to FIG. 2, when electric current is supplied to the solenoid valve 21 it opens and allows the fuel to flow from the working chamber 10 through the throttling slot 30 to poppet chamber 29, further through bypass channel 31 to HDV control chamber 5 and out through spill port 3. The flow area of the throttling slot 30 is such that said flow through it causes the hydraulic force to act on the HDV 4 in the direction of the flow which holds the HDV closed with the additional assistance of the force exerted by the spring 32. When pressure in the working chamber 10 has decreased to a certain level piston 6 and plunger 7 move up under the pressure in the compression chamber 12, the fuel pressure being transmitted through the non-return valve 19. At a certain point in the travel of the plunger its groove 8 closes the connection between compression chamber 12 and the cut-off channel 20 and whilst at or beyond this point it isolates cut-off channel 20 and thereby the locking chamber 17 from the compression chamber 12. At a certain point of further upward movement of the plunger its groove 8 opens the connection between the cut-off channel 20 and the control channel 22 thereby connecting the locking chamber 17 with control channel 22 and whilst at or beyond this point it keeps locking chamber 17 and control channel 22 connected with each other. By this means the pressure in the locking chamber 17 equalizes with the pressure in the control channel 22 which is set by the system 23. Also, at the certain point in the travel of the plunger its edge 9 closes off the connection between spill chamber 11 and spill port 3 and whilst at or beyond this point the spill port 3 and spill chamber 11 remain disconnected from each other. The period of time during which piston 6 and plunger 7 move up is determined by the duration of opening of the solenoid valve 21 which is in turn determined by the duration of the current supplied by the engine management system (not shown). When piston 6 and plunger 7 have reached the required position which is determined by the fuel delivery required at that instant, the current is switched off by the engine management system and the solenoid valve 21 closes thereby isolating the HDV control chamber 5 and spill port 3. As a result, the fuel flow via the throttling slot 30 stops and the hydraulic force holding the HDV 4 closed ceases to act. The fuel pressure in the inlet port 2 acting on the differential spot in the HDV overcomes the force of spring 32 and provides an initial opening of the HDV. This allows fuel to flow through the inlet port 2 to the poppet chamber 29 and via the throttling slot 30 to working chamber 10 and via the bypass channel 31 to HDV control chamber 5. This fuel flow increases the pressure in poppet chamber 29 and HDV control chamber 5 and forces HDV 4 to fully open. The pressure in the working chamber 10 rises and causes the piston 6 and the plunger 7 to move down thereby compressing the fuel in the compression chamber 12 and closing the non-return valve 19.

As the fuel pressure in the compression chamber 12 increases, the pressure in the nozzle's outlet chamber 18 also increases and opens the nozzle 14, overcoming the force of spring 16 and pressure in the locking chamber 17 and lifting needle 15 off its seat. The moment of nozzle opening and correspondingly the pressure developed in the compression chamber 12 at the moment of nozzle opening depends on the pressure in the locking chamber 17 which is equal to the pressure in the control channel 22 set by the system 23. At the moment of nozzle opening the needle 15 displaces portion of the fuel from the locking chamber 17 through cut-off channel 20, groove 8 and control channel 22 to the system 23, causing a pressure surge in the control channel 22 which is detected by the pressure sensor 25. The amplitude of said pressure surge can be adjusted by well known means of restricting the flow area of the control channel downstream of the pressure sensor. During an injection stroke of the piston 6 and the plunger 7 fuel is injected through opened nozzle 14. At a final stage of an injection stroke the groove 8 disconnects the cut-off channel 20 from the control channel 22 and then opens the connection between the compression chamber 12 and the cut-off channel 20. Also, at a final stage of an injection stroke the edge 9 opens the connection between the spill chamber 11 and spill port 3. With the cut-off channel 20 and compression chamber 12 connected to each other the pressures in locking chamber 17 and compression chamber 12 equalise and the needle 15 closes nozzle 14 and the piston 6 and the plunger 7 stay at the bottom of the stroke. When the piston is stationary there is no fuel flow through the HDV 4 and the pressures in the working chamber 10, poppet chamber 29 and HDV control chamber 5 equalise with the pressure in the inlet port 2 and the spring 32 moves the HDV up and closes it. Thus the system returns to the initial position as shown in FIG. 1.

In FIG. 3 the fuel injection system works in the same way. When the piston 6 and the plunger 7 travel upwards from the bottom position to a certain point where the edge 9 closes off the connection between spill chamber 11 and spill port 3, the non-return valve 33 opens and allows an unrestricted flow of fuel through the spill channel 13 from spill port 3 to spill chamber 11. During an injection stroke, when piston 6 and plunger 7 move down from the point where the edge 9 opens the connection between the spill chamber 11 and the spill channel 13, the non-return valve 33 is closed and the fuel flows from spill chamber 11 to spill port 3 through the bypass spill channel 34. The flow area of the bypass spill channel 34 is chosen such that it provides sufficient restriction to the fuel flow to raise the pressure in the spill chamber 11 to a level when the hydraulic cushion in the spill chamber provides smooth deceleration of the piston 6 at the end of an injection stroke.

Figure 7:
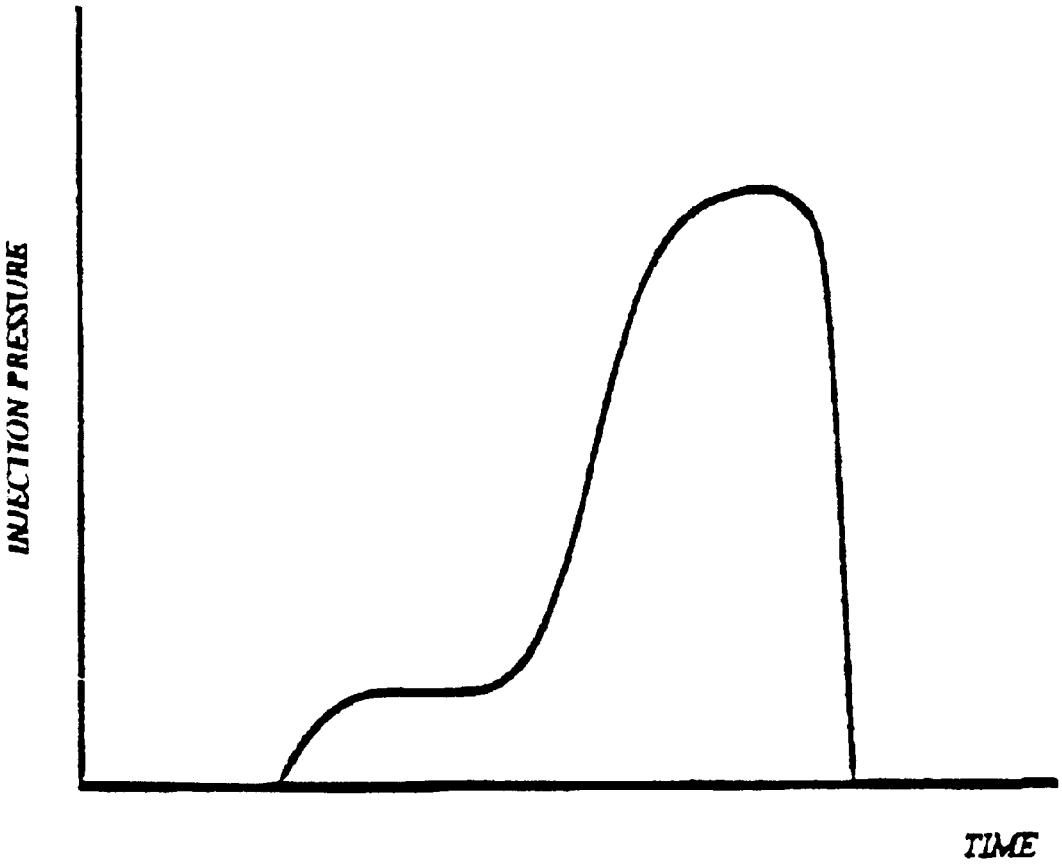
FIG. 7 is a graphical representation of a boot-shaped injection.

In FIG. 4 the fuel injection system works in the same way. When a smoother leading edge of an injection curve is required the additional solenoid valve 36 connects the control channel 35 to spill port 3 prior to an injection start relieving the pressure from the locking chamber 17 and thereby allowing the needle 15 to open nozzle 14 earlier during an injection stroke of the plunger at a lower pressure in the outlet chamber 18. When a so-called "boot-shaped" injection is required, as exemplified by the graphical plot of FIG. 7, a relatively weak spring 16 is used, so that when the additional solenoid valve 36 opens during an upward travel of the plunger 7 a relatively low pressure in the outlet chamber 18 lifts the needle 15 and opens the nozzle 14, and fuel gets delivered to an engine's cylinder at a relatively low rate from the inlet port 2 via non-return valve 19 until an injection stroke of the plunger takes place and the remainder of an injection occurs the usual way described earlier. The amount of fuel delivered during the boot-phase of injection is controlled by adjustment of a time period between the opening of the additional solenoid valve 36 and the closing of the solenoid valve 21.

In FIG. 5 the fuel injection system works in the same way, but has the ability to provide a separate pilot injection during an upward movement of the pressure intensifier. In this embodiment the maximum flow area of the additional solenoid valve 36 and the flow area of link channel 37 are chosen in such a way that when the additional solenoid valve opens during an upward movement of the pressure intensifier the flow rate through it from the control channel 35 is greater than the flow rate via the link channel 37 from the inlet port 2, which causes a drop of pressure in the locking chamber 17 sufficient for the pressure in the outlet chamber 18 to lift the needle 15 and start a pilot injection. When the additional solenoid valve 36 closes before the main injection, the flow of fuel through it stops and pressure in the locking chamber 17 equalises with pressure in the inlet port 2, the fuel from inlet port entering the locking chamber through link channel 37 and non-return valve 38. With pressure in the locking chamber equal to the pressure in the outlet chamber the spring 16 closes the nozzle 14 and the pilot injection stops. In this embodiment of the present invention the amounts of fuel and timing of pilot and main injections are controlled separately by the additional solenoid valve 36 and the solenoid valve 21 respectively.

The electronic conditioning unit (ECU) shown in FIG. 6 works as follows. It receives on input 41 a stop trigger from an engine management system which is initiated by the cessation of a control pulse supplying an electric current to the solenoid valve 21 (Ref. FIG. 1) and transmits said stop trigger to the reset-start count input of the counter 43 (FIG. 6). The ECU also receives on the input 40 the signal from the pressure sensor 25 (Ref. FIG. 1) which is transmitted to the filter 44 (Ref. FIG. 6) and to one of the inputs of the comparator 42. The filtered signal after filter 44 is transmitted to the other input of the comparator. The comparator generates a surge trigger when the difference between the two input values exceeds a predetermined threshold, said surge trigger is transmitted to the counts input of counter 43. The counter is set to generate an output trigger when it overflows, and the maximum number of counts is set to zero, thus the counter transmits a trigger to the ECU output 39 when there is a pressure surge in the control channel 22 (Ref. FIG. 1) caused by the opening needle 15. The ECU output remains unaffected by any pressure surges occurring outside the period between the stop trigger and the first pressure surge after the stop trigger.

The advantages of the embodiments of the present invention over known fuel injection systems are achieved mainly by the following means:

- the provision of the external groove 8 on the plunger 7;
- the provision of the control channel 22, which may be connected to the cut-off channel 20 depending on the position of the plunger 7, and the application of the system 23 which is connected to the control channel 22 and which can vary the pressure in the control channel according to an engine management system command;
- the application of the pressure sensor 25 installed in the control channel 22 and feeding its signal to the electronic conditioning unit (ECU) which generates the start of an injection trigger;
- the application of the additional solenoid valve 36 installed in the control channel 35 which is connected to the cut-off channel 20;
- the application of the link channel 37 between the inlet port 2 and the locking chamber 17 and the non-return valve 38, the input of which is connected to the inlet port and the output of which is connected to the locking chamber;
- the application of the spill channel 13 connecting the spill chamber 11 to the spill port 3 which may be closed off by the edge 9 of the plunger 7 depending on the plunger's position;
- the application of the non-return valve 33 the output of which is connected to the spill chamber 11 and the input of which is connected to the spill port 3, and the application of the bypass spill channel 34 connecting the inlet and the outlet of the non-return valve 33.

The application of the external groove 8 (FIG. 1) on the plunger 7 which is used to connect the compression chamber 12 to the cut-off channel 20 instead of a cut-off port in the plunger permanently connected to the compression chamber via a bore in the plunger as shown in PCT/AU98/0073 allows the use of a smaller diameter plunger. In the case of PCT/AU98/0073 a high pressure present in the bore of a plunger tends to expand it and in case of too small a diameter of the plunger this expansion can cause plunger seizure. In a fuel injection system according to an embodiment of the present invention there is no bore in the plunger 7 and the plunger diameter is not limited by the design of the groove 8.

Figure 8:
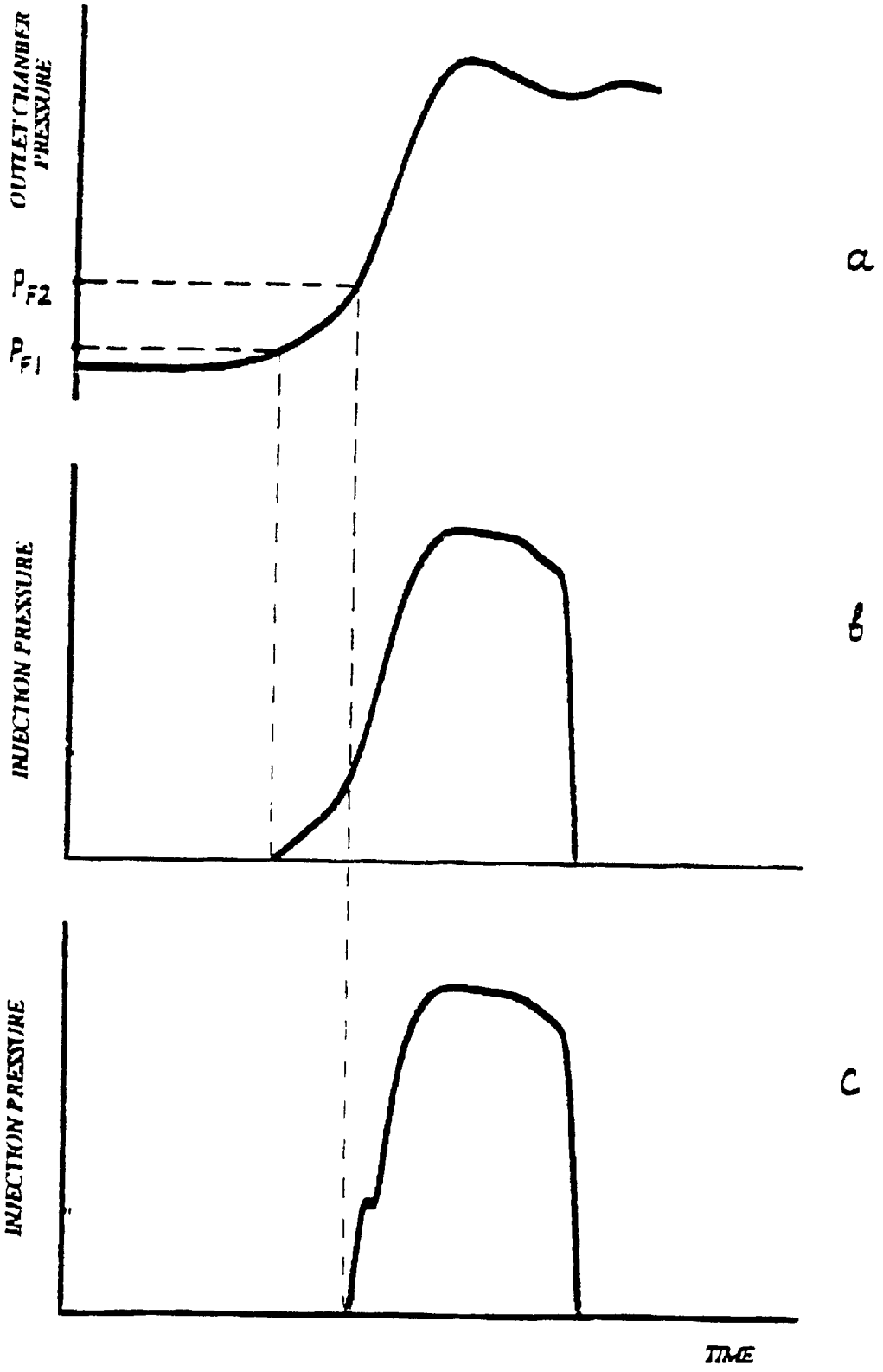
FIG. 8 is a graphical representation of outlet chamber pressure relative to injection pressure.

The application of the control channel 22, which may be connected to the cut-off channel 20 depending on the position of the plunger 7, and the application of the system 23 which is connected to the control channel 22 and which can vary the pressure in the control channel according to an engine management system command, allows an engine management system to control the shape of a leading edge of an injection curve. This is possible because during upward travel of piston 6 and plunger 7 the groove 8 firstly disconnects the cut-off channel 20 from the compression chamber 12 and then connects cut-off channel to control channel 22. The cut-off channel is permanently connected to the locking chamber 17, therefore the pressure in the locking chamber equalises with the pressure in the control channel before an injection takes place. When a slower rise of an injection pressure and rate is required in the beginning of an injection process the system 23 in response to the command of the engine management system decreases the pressure in the control channel 22 thereby decreasing the pressure in the locking chamber. It enables a lower pressure $P_{F1}$ as indicated in FIG. 8*a,* in the outlet chamber to lift the needle 15 off its seat, therefore the nozzle opens earlier in the beginning of a plunger's injection stroke when the pressure in the compression 12 and outlet 18 chambers has not yet been built up to a higher level. The effect of this is a more gradual rise of the injection pressure in the beginning of the process, as shown in FIG. 8*b.* When a steep leading front of an injection curve is required, the system 23 increases the pressure in the control channel 22 and therefore in the locking chamber 17 at the beginning of an injection stroke, the nozzle starts to open later with higher pressure $P_{F2}$ (FIG. 8*a*) in the compression 12 and outlet 18 chambers, which results in a sharp rise of injection pressure as shown in FIG. 8*c.*

The use of control channel 22 in the injectors and a system 23 which is common for a set of injectors of a multi-cylinder engine presents another advantage in that it improves the repeatability of injection timing in the consecutive injections and the uniformity of injection timing throughout the set of injectors, because it stabilizes the locking chamber pressures at a uniform level for every cycle of injection and for each injector, making it practically independent from the mechanical conditions of an injector such as a wear of the plunger.

The use of control channel 22 in the injectors and a system 23 which is common for a set of injectors of a multi-cylinder engine is also advantageous in terms of unit injector design simplicity as well as the injection system as a whole because only one pressure control system for the control channels is required and in some cases this system may be just a valve connecting the control channels either to spill port 3 or to inlet port 2. Furthermore, only one pressure sensor 25 may be required because the injection timings of different injectors within the set are determined by a common source of pressure in the system 23 and therefore their correlations with the pressure in the control channel with the single sensor installed in it are identical.

The use of the pressure sensor 25 in the control channel 22 and the ECU providing the start of injection trigger allows for a more accurate control of fuel delivery as it enables a closed loop control of injection timing.

The use of the control channel 35 (FIG. 4) connected to the cut-off port 20 and the additional solenoid valve 36 in the control channel 35 allows control of the injection pressure of very-small fuel deliveries independently from the base pressure. It also allows a wider range of control of an injection curve. The pressure in the control channel 35 and therefore in the locking chamber 17 can be relieved immediately after the groove 8 disconnects cut-off channel 20 from compression chamber 12 during an upward travel of plunger 7, making it possible to provide an additional control over the injection pressures of very small fuel deliveries. With such an embodiment of the present invention it is also possible to use a weaker spring 16 of the needle 15, so that when the pressure in the locking chamber 17 is relieved to a certain level the base pressure in the outlet chamber 18 lifts the needle 15 and opens the nozzle 14. By this means even greater control of the leading edge of an injection curve can be achieved because an injection can be started during an upward movement of the plunger 7 by opening the additional valve 36. In this case the injection will be started with the base fuel pressure and after the solenoid valve 21 closes and the additional solenoid valve 36 closes the injection stroke of the plunger and the main injection will take place, which will be terminated in the way described earlier. It is also possible to control the rate of injection cut-off by opening additional solenoid valve 36 during an injection cut-off period which will reduce the pressure in the locking 17 and compression 12 chambers and will slow down the rate of nozzle closing.

The use of the link channel 37 and the non-return valve 38 as shown in FIG. 5 makes it possible to provide a pilot injection separately from the main injection performed by the injection stroke of the plunger 7 by opening and closing the additional solenoid valve 36 during an upward travel of the plunger and before the solenoid valve 21 closes.

The application of the spill channel 13 (FIG. 1) connecting the spill chamber 11 to the spill port 3 which may be closed off by the edge 9 of the plunger 7 depending on the plunger's position instead of a non-return valve as shown in a prior art simplifies the unit injector design while achieving the same goal of preventing the admission of fuel into the spill chamber 11 during an upward movement of piston 6 and plunger 7 which helps to keep the pressure in spill chamber 11 low during an injection stroke of the plunger.

The application of the non-return valve 33 (FIG. 3) the output of which is connected to the spill chamber 11 and the input of which is connected to the spill port 3, and the application of the bypass spill channel 34 connecting the inlet and the outlet of the non-return valve 33 reduces the noise of the injector operation because during the initial stage of an upward movement of piston 6 and plunger 7, when the spill channel 13 is still connected to the spill chamber 11, the non-return valve opens and allows an increased volume of fuel to enter spill chamber 11 before the edge 9 closes spill channel 13. During the final stages of an injection stroke this increased amount of fuel in the spill chamber provides greater deceleration of the piston 6 because when the edge 9 opens spill channel 13 the non-return valve 33 remains closed and fuel from spill chamber 11 is discharged to the spill port 3 through the bypass spill channel 34 which restricts the flow. The increased deceleration of the piston 6 reduces the impact speed of the piston when it comes to rest in the bottom position, reducing both mechanical noise and the noise of a hydraulic shock occurring during an abrupt stop of the piston.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A fuel injector of an injection system for an internal combustion engine, said injector comprising an inlet port; a spill port; a pressure intensifier comprised of a piston forming a working chamber and a spill chamber and a plunger forming a compression chamber, said spill chamber being connected to the spill port via a spill channel, said plunger having a control edge adapted to vary the flow area of said spill channel and close it off in dependence upon the plunger position; a nozzle with a needle, a locking chamber, means biasing the needle to close the nozzle and an outlet chamber connected to the compression chamber; a non-return valve, the inlet of the non-return valve being connected to the inlet port and the outlet of the non-return valve being connected to the compression chamber; an hydraulically controlled differential valve (HDV) comprising an HDV control chamber and having a valve located between the inlet port and the working chamber and opening into the working chamber upon opening, wherein said valve provides a throttling slot and a chamber connected to the HDV control chamber; resilient means biasing the HDV towards its closed position; a control valve installed between the HDV control chamber and the spill port; a cut-off channel connected to the locking chamber; a control channel connected to the spill port; said plunger having an external groove positioned so as to connect the cut-off channel to the compression chamber at an injection cut-off position of the plunger and adapted to connect the cut-off channel to the control channel at other positions.

2. A fuel injector of an injection system for an internal combustion engine, said injector comprising an inlet port; a spill port; a pressure intensifier comprised of a piston forming a working chamber and a spill chamber and a plunger forming a compression chamber, said spill chamber being connected to the spill port via a spill channel; said plunger having a control edge adapted to vary the flow area of said spill channel and close it off in dependence upon the position of the plunger; a nozzle with a needle, means biasing the needle to close the nozzle, an outlet chamber connected to the compression chamber and a locking chamber, a non-return valve, the inlet of the non-return valve being connected to the inlet port and the outlet of the non-return valve being connected to the compression chamber; an hydraulically controlled differential valve (HDV) comprising an HDV control chamber and having a valve located between the inlet port and the working chamber and opening into the working chamber upon opening, wherein said valve provides a throttling slot and a chamber connected to the HDV; resilient means biasing the HDV towards its closed position; a control valve installed between the HDV control chamber and the spill port and adapted to connect said HDV control chamber with the spill port upon command from an engine management system; a cut-off channel connected to the nozzle locking chamber; a control channel connected to the cut-off channel; an additional control valve installed between the control channel and the spill port; said plunger having an external groove positioned so as to connect the compression chamber to the cut-off channel during an injection cut-off position of the plunger.

3. A fuel injector as claimed in claim 2 wherein the control valves are solenoid valves.

4. A fuel injector as claimed in claim 2 wherein the valve located between the inlet port and the working chamber is a poppet with a seating face.

5. A fuel injector according to claim 2 wherein there is a link channel connecting the locking chamber to the inlet port; a non-return valve installed between the locking chamber and the inlet port, the outlet of said non-return valve being connected to the locking chamber, further wherein the flow areas of the link channel and the additional solenoid valve are such that when the additional control valve is open and the compression chamber is disconnected from the cut-off channel the pressure in the locking chamber becomes less than the pressure in the inlet port and the nozzle opens.

6. A fuel injector according to claim 2 wherein there is a means for detecting the start of injection moments comprising a pressure sensor installed in the control channel and an electronic conditioner unit.

7. A fuel injector according to claim 2 wherein the plunger is adapted to open or close off the spill channel in dependence upon position of the plunger.

8. A fuel injector according to claim 5 wherein there is a non-return valve installed in the spill channel, the inlet of said non-return valve being connected to the spill port; a bypass spill channel connecting the outlet of said non-return valve to the spill port.

9. A fuel injection system in combination with at least one injector as claimed in claim 2 comprising means for controlling the pressure in the control channel and means for detecting the start of injection.

10. A fuel injection system as claimed in claim 9 wherein the means for detecting the start of injection comprises a pressure sensor installed in the control channel and an electronic conditioning unit.

11. A fuel injector according to claim 3 wherein there is a link channel connecting the locking chamber to the inlet port; a non-return valve installed between the locking chamber and the inlet port, the outlet of said non-return valve being connected to the locking chamber, further wherein the flow areas of the link channel and the additional solenoid valve are such that when the additional control valve is open and the compression chamber is disconnected from the cut-off channel the pressure in the locking chamber becomes less than the pressure in the inlet port and the nozzle opens.

12. A fuel injector as claimed in claim 2 wherein the valve located between the inlet part and the working chamber is a poppet with a seating face.

13. A fuel injector as claimed in claim 1 wherein the valve located between the inlet part and the working chamber is a poppet with a seating face.

14. A fuel injector according to claim 1 wherein there is a means for detecting the start of injection moments comprising a pressure sensor installed in the control channel and an electronic conditioner unit.

15. A fuel injector according to claim 1 wherein the plunger is adapted to open or close off the spill channel in dependence upon position of the plunger.

16. A fuel injection system in combination with at least one injector as claimed in claim 1 comprising means for controlling the pressure in the control channel and means for detecting the start of injection.

* * * * *